United States Patent [19]

Shields

[11] Patent Number: 4,982,957

[45] Date of Patent: Jan. 8, 1991

[54] ALIGNMENT APPARATUS FOR USE IN FREEWEIGHT BARBELL SYSTEMS

[76] Inventor: William D. Shields, 3031 Dalehurst Dr. West, Jacksonville, Fla. 32211

[21] Appl. No.: 402,865

[22] Filed: Sep. 5, 1989

[51] Int. Cl.[5] ..... A63B 21/075

[52] U.S. Cl. ..... 272/123; 272/117

[58] Field of Search ..... 272/117, 118, 122, 123, 272/124, 93

[56] References Cited

U.S. PATENT DOCUMENTS

| | | | |
|---|---|---|---|
| 3,612,523 | 10/1971 | Glynn | 272/118 |
| 4,093,214 | 6/1978 | Coker et al. | 272/118 |
| 4,529,198 | 7/1985 | Hettick, Jr. | 272/123 |
| 4,822,034 | 4/1989 | Shields | 272/123 |

FOREIGN PATENT DOCUMENTS

| | | | |
|---|---|---|---|
| 1347948 | 10/1987 | U.S.S.R. | 272/118 |

*Primary Examiner*—Robert Bahr
*Attorney, Agent, or Firm*—Arthur G. Yeager

[57] ABSTRACT

Apparatus for improved alignment of the components of a freeweight barbell system include a weight tray employing spacing members for lateral support of the weights when stored upright thereon. The bar includes sleeves having shoulders to further align the weights when mounted on the bar. Guide channels include rearward downwardly disposed ramps to minimize contact of the weights with the tray surface until the bar has been moved to the rearward position. Interior weight support channels minimize bending of a weighted bar to ease movement and prevent lateral misalignment of the weights. Two alternate retaining clips are provided to improve the securing of the weights which themselves have been reformed to also improve support, guidance and alignment of the weights whether stored or secured to the bar.

22 Claims, 3 Drawing Sheets

ALIGNMENT APPARATUS FOR USE IN FREEWEIGHT BARBELL SYSTEMS

FIELD OF THE INVENTION

The present invention pertains to barbell systems employing freeweights and to improved alignment apparatus for use therewith.

PRIOR ART

In U.S. Pat. No. 4,822,034, applicant describes a barbell system employing freeweights that combines apparatus for improved safety as well as substantial advantages regarding ease of use and flexibility. The present invention is directed towards improvements in the barbell system of U.S. Pat. No. 4,822,034 which provide greater ease of use and weight alignment.

With respect to FIGS. 1 and 3 in the '034 system, the weight tray assembly 48 includes a weight bearing support plate 57 and pins 93 which protrude forwardly of rear wall 49. The weights 68 stand upright on plate 57 with pins 93 fitting within slots 94 when stored. The pins 93 provide lateral stability. The present invention improves greater stability by dispensing with the pins 93 and utilizing triangular spaces mounted on plate 57. In adddition, spacers at the outer edge of tray assembly 48 provide for the lateral stability for the outermost weights.

The prior art used guide channels 59 with upstanding walls 62, 63. The present invention employs outwardly extending section that functions as a "funnel" member to further assist the user in returning the barbell assembly to the guide channels 59. Also, with respect to the guide channels 59, the present invention includes a downwardly extending ramp at the rearwardmost portion of the channels 61. The ramps slope down at a 15° angle for easier storage of the weights. Also, the weights will be slightly lifted off bearing surface 57 as the bar is moved forwardly up the ramp. The size of the guide wheels and the low 15° angle offers no material change in the effort that needs to be supplied to move the bar forwardly.

The improved guide and support apparatus also includes a coaxially mounted pair of sleeves as does the prior art but with an important difference with respect to weight spacing and alignment rather than the spaced sleeve grooves 86, the present invention employs circumferentially mounted shoulders or ribs which act to space the weights apart and provide better alignment. In the present invention, the spacer ribs are integral to the sleeves as the sleeves are machined from heavy tubing.

An important improvement that is directed at ease of use and safety is the provision for an inner pair of guide or support channels located above the inner edge of the tray surface 57 and below respective alignment bars 52. These support channels include ramps similar to those of the outer guide channels. The bar includes rotatable wheels that fit into the support channels. This assembly prevents "flex" or bending of the bar when it is weighted down. In addition to the greater support for the loaded bar, this feature also prevents "binding" of the weight assembly due to the flex because of very heavy weight loading.

The shape of the weights 60 has also been changed to improve ease of use. The locking mechanism has also been modified to provide improved securing of the weights to the bar or in stored position. Finally, rubber strips have been added to provide for noise reduction.

The result is a group of improvements that can be used singly or in combination for more precise alignment of the components of a freeweight system during storage or in operation.

SUMMARY OF THE INVENTION

The barbell weight lifting apparatus of the prior art includes a frame comprising an elongated lifting bar having opposite end portions, a plurality of planar weights adapted to be selectively attached to the bar and selective means for detachably securing the weights to the bar. Each weight has an identically positioned horizontally disposed lateral slot therein extending from a generally upright edge of the weight to generally medially thereof. The bar is positionable through each slot and is selectively secured to selective weights. Support means for movably positioning and storing said weights upstanding in a horizontal row includes a pair of spaced weight receiving trays each having an upper surface and being affixed to the frame adjacent respective end portions of the bar. In accord with one aspect of the present invention an improvement in the prior art barbell weight lifting apparatus includes alignment means attached to each weight tray to align the weights thereon and includes a plurality of upright spacing members spaced along and affixed to the upper surface of the tray for aligning the weights horizontally when the weights are stored on the tray. The spacing members are preferably elongated triangular elements having a horizontal base affixed to the upper surface.

Another aspect is seen wherein the alignment means also includes a pair of elongated spaced guide channels respectively along a side of an adjacent weight receiving tray to accommodate a pair of spaced round guide wheels mounted on respective end portions of the bar and being disposable in corresponding guide channel for positioning the bar in horizontal alignment with all slots of said weights. Each guide channel has a front end portion and a rear end portion with a downwardly disposed ramp portion on each rear end portion. The guide wheels are disposed on corresponding ramp portion when the bar is positioned through each slot in respective weights. The guide wheels are sized in diameter such that selected weights are lifted off the upper surface of the tray when the bar is moved forwardly to move the guide wheels forwardly and upwardly on respective ramp portions. In addition, the guide channels include an outer edge portion and an inner edge portion and a substantially vertical wall adjacent to the outer edge portion which includes a frontal wall portion and a rearward wall portion including an outwardly extending section on the frontal wall portion to guide respective wheel inwardly into the channel. Also, a spaced outer weight support element is affixed to the upper surface of each tray and is positioned outwardly adjacent the outermost weight positionable on the tray to provide lateral alignment of the weight.

In accord with other aspects of the invention the alignment means further includes a pair of spaced sleeves coaxially positioned around the lifting bar with each said sleeve having a plurality of spaced apart circumferential shoulders thereon which define between each pair thereof a weight engaging area of the bar for positioning each weight in an area. A movable lever is pivotally mounted on a side of each weight with a first position transversing the slot forwardly of the bar for securing the bar in the slot to secure the weight to the bar in a weight engaging area and a second position removed from the slot for allowing free movement of the bar into and out of the slot. Means to engage said lever by way of a protruding portion thereon in the second position is provided and inhibits movement of a released weight during movement of the bar into and out of the slot. The alignment means also includes a pair of spaced apart bar support elements mounted on the bar at a point intermediate the length thereof and a pair of elongated spaced bar support channels affixed to the frame and being positioned below a corresponding support element which includes a wheel. The support elements are disposed on the support channel when the bar is positioned in horizontal alignment with the slots in the weight for restricting downward movement of the intermediate portion of the bar. The support channel has a front end portion and a rear end portion with a downwardly disposed ramp portion. Each bar support element is disposed on a ramp portion when the bar is positioned through each slot in respective weight.

The alignment means further includes an improved weight having planar sides and a bottom portion having a forward portion and a rearward portion. The rearward portion is tapered upwardly to reduce interference when the weight is moved rearwardly onto the weight receiving tray. The weight is pivotal 5°-20° forwardly about the bar when it is selectively secured to the bar. The slot in each weight has a substantially horizontal bottom surface and a top surface disposed downwardly from an upright edge to a point generally medially in weight and the vertical distance between the bottom surface and the top surface is proportioned to allow for restricted vertical movement of the bar as the bar is movably positioned along the slot.

In another aspect of the present invention a retaining clip is pivotally attached to one side of each weight having a forward portion which transverses the slot forward of the bar when the bar is positioned within the slot to select the weight when the clip is pivoted to a first closed position for securing the weight thereby in the corresponding engaging area. The alignment means further includes means to engage the clip, the clip including a rearward portion having a finger portion for engaging the means when the clip is pivoted open to a second open position to release a selected weight. The means cooperates with the finger portion to inhibit movement of such released weight from the upright stored position. The forward portion of the clip is formed as a hook member having an interior surface which is closely adjacent the bar when the clip is in the first position and includes a tab which extends below the slot. The forward portion of the clip extends to a point below the slot when the clip is in the first position to inhibit the opening of the clip when the bar is moved forwardly. The support means includes a substantially vertical wall having a plurality of spaced vertically disposed slots therethrough and the finger portion of the clip is disposable within a corresponding slot when the clip is in the second position.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
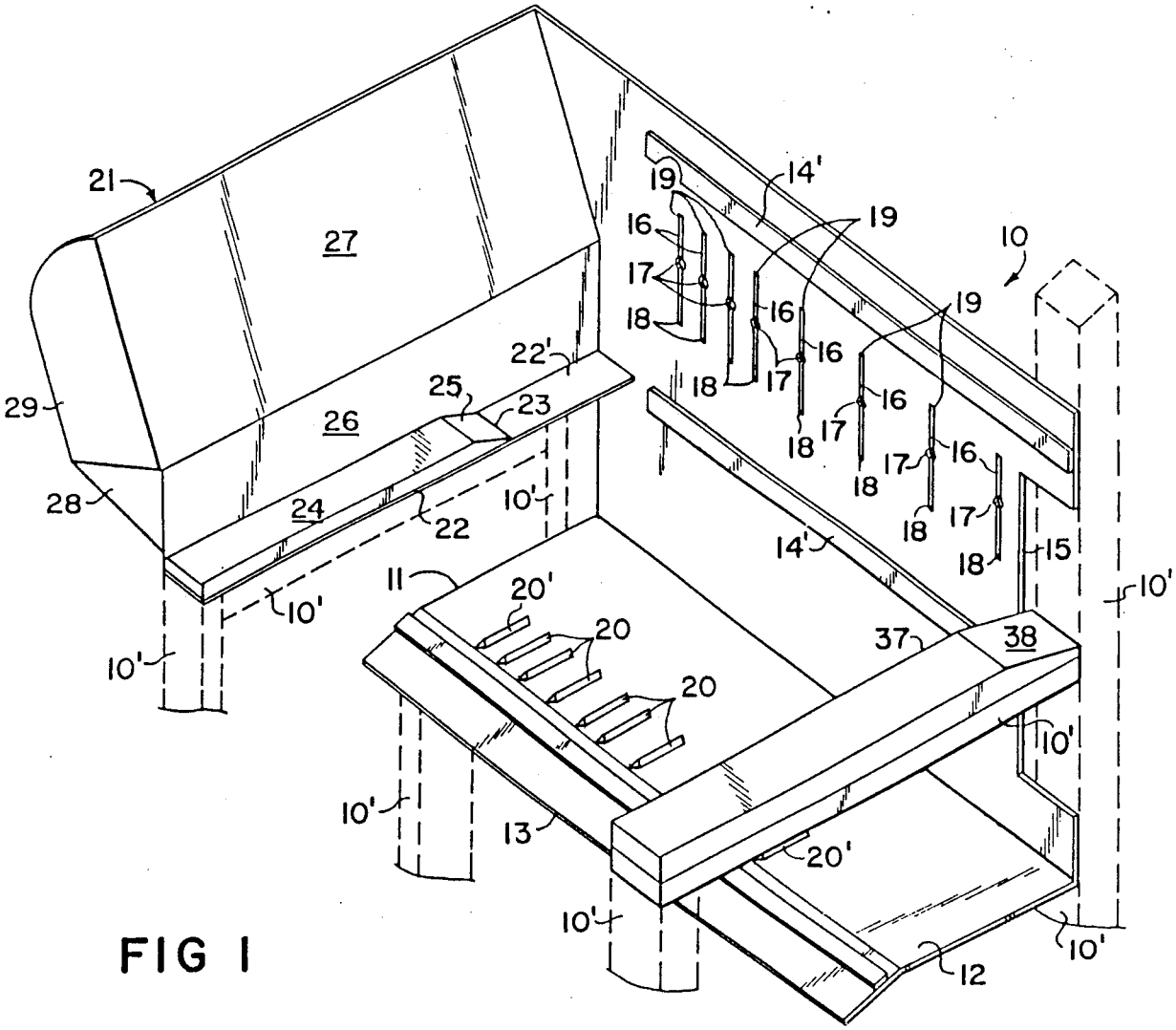
FIG. 1 is a perspective view illustrating the left end portion of the weight tray assembly and guide and support channel assemblies used in the present invention for improved alignment of the components of a free-weight barbell system, the right end portion being the mirror image thereof.

Referring now to the drawings, the improved alignment apparatus in accord with the present invention includes a weight tray assembly which has been modified and is depicted generally at 10 in FIG. 1. The frame 10' is substantially identical to that employed in the prior art although it is to be understood that the exact size and arrangement of the frame 10' will depend upon the number of weights employed and the total weight that is available. In addition, the present invention contemplates the barbell assembly configured for use in a bench press exercise. Other configurations are possible depending upon the intended exercises.

Weight tray 11 has an upper surface 12 and a forward downwardly depending lip 13 with a rubber strip 14 affixed thereto for noise reduction as will be further discussed hereinbelow. A rear wall 15 includes a plurality of retaining clip slots 16 with a circular hole 17 to allow for slight weight misalignment.

The slots 16 are formed with a lower and upper edge 18, 19, respectively. Two rubber strips 14' are affixed to the rear wall 15 for noise reduction. The surface 12 of weight tray 11 has a plurality of weight spacing members 20 shaped as a triangle with the base affixed by welding to surface 12. The outermost spacers 20' provide additional lateral support for the weights 39 as will be discussed hereinbelow.

Guide channel assembly 21 includes a guide channel 22 having surface 22' and a ramp member 24 mounted thereon. Ramp member 24 includes surface 25 and downwardly disposed ramp 23. A vertical wall 26 has an upper laterally extending member 27 and two outwardly extending sections 28, 29 welded together and to the forward edge of member 27. Ramp 23 declines rearwardly at an angle of 15°.

Weight support channel 37 has rearward 15° ramp portion 38 and is welded to the frame 10' as appropriate in the configuration of the system. Weight support channels 37 are positioned over an interior portion of weight tray 11 and are used to provide support for the intermediate portion of bar 30 which can flex under heavy load.

Figure 2:
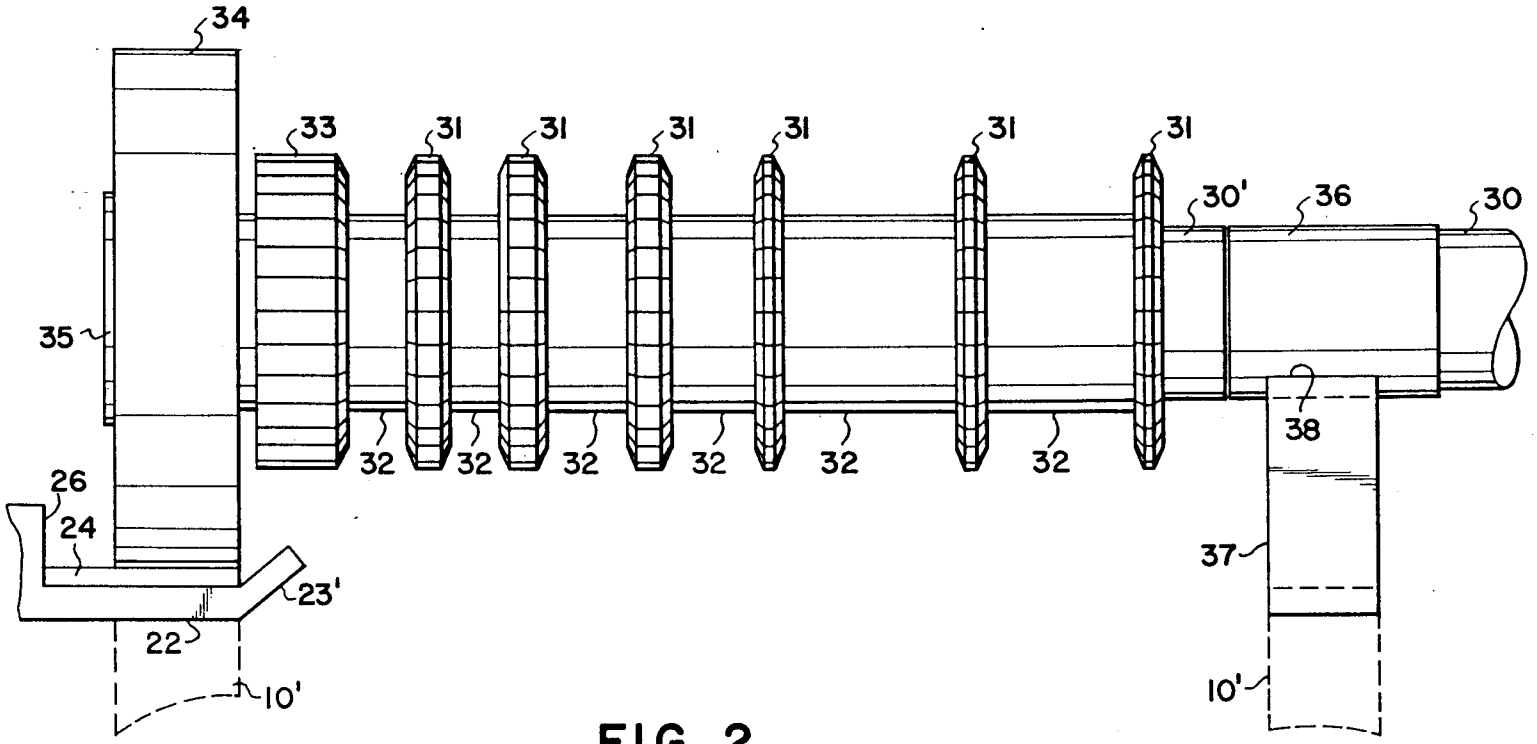
FIG. 2 is an enlarged front elevational view of the left end portion of the bar having improved alignment in accordance with the present invention.

With respect now to FIG. 2, the barbell 30 has a coaxially mounted sleeve 30' on either end. The sleeve 30' is machined to provide shoulders 31 defining weight engaging areas 32 therebetween. Each sleeve 30' is usually rotatably mounted on bar 30 and may be supported by bearings (not shown) if heavy weight loading is possible. An outermost shoulder 33 fits against wheel 34 which is preferably a roller bearing mounted on sleeve 30' via collar assembly 35. Weight support element 36, which is preferably a wheel, rides on support channel 37 and is preferably mounted to bar 30 by bearings (not shown). Collar assembly 35 includes a snap ring (not shown) and is mounted in a conventional manner as understood in the art. An additional interior wall 23' may be used to inhibit lateral movement of the wheel 34.

Figure 4:
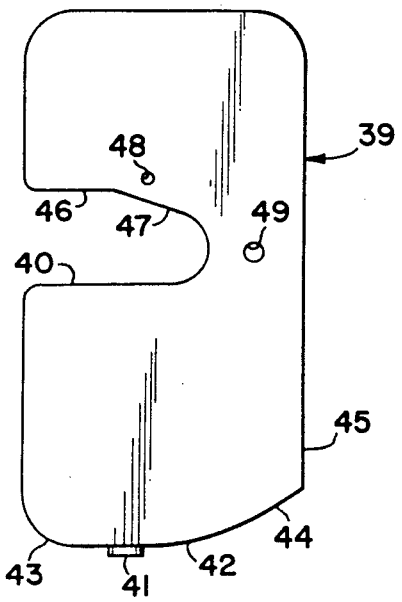
FIG. 4 is a side elevational view of the weight used in FIG. 3.

With reference now to FIG. 4, the improved weight 39 has slot 40 and a single bottom weight pad 41. The bottom 42 of the weight 39 has a slightly tapered forward edge 43 and a larger tapered portion 44 at the rearward edge which is connected to substantially vertical rear edge 45. The slot 40 has been modified by raising the forward upper surface 46 thereof as referenced rearwardly, and machining a rearward portion 47 thereof at a slightly greater downward angle to accommodate the movement of bar 30 when resting on guide channel 22 and support channel 37 and moving on the respective ramps 23 and 38. Ball detent depression 48 and bolt hole 49 will be discussed herebelow when the operation of the weight selection apparatus is described.

With respect again to FIGS. 1 and 2, weights 39 normally stand upright on tray surface 12 via pads 41 which reduce sliding friction. When barbell 30 is moved rearwardly onto the ramps 23 and 38 the sleeve 30' will move into weight slot 40 downwardly under surface 46 and then to surface 47. Weight spacing members 20 fit between the stored weights 39. The shoulders 31 fit over spacers 20 for the positioning of weight slot 40 against sleeve 30' at the weight engaging areas depicted as 32. As the bar 30 is moved forwardly with one or more selected weights 39, the upward movement of the bar 30 on ramps 23 and 38 starts the lifting of the selected weights 39 off the tray surface 12. This lifting action is the result of the vertical height of the respective channels 22 and 37 and the diameter of wheels 34 and 36 which control the relative vertical position of lifting bar 30 as it is moved back and forth. The wheel size and ramp angle is chosen to minimize the total force necessary to move the weighted bar 30 forwardly. The surfaces 24 and 25 and channel 37 are preferably plastic and ramps 23 and 38 are only ¼ inch in height. Preferably, the initial lifting action is at least sufficient to substantially reduce the friction between the tray surface 12 and the weight pad 41 for further ease of movement of the weighted bar 30. Finally, ramp members 24 and 37 may be formed integrally with the framing 10' and, for example, channel 22 for reasons of cost.

As the selected weights 39 are returned to the stored position on tray 11, the upraised portion 24 of guide channels 22 results in the weights 39 being at least ¼ inch above tray surface 12 until the bar 30 is moved down the ramp 23 on guide wheels 34. This feature, along with the tapered rear portion 44 of weights 39 insures that the weights do not "hang-up" in a tilted manner on tray 11 but are moved to the stored upright position against rear wall 15.

Figure 3:
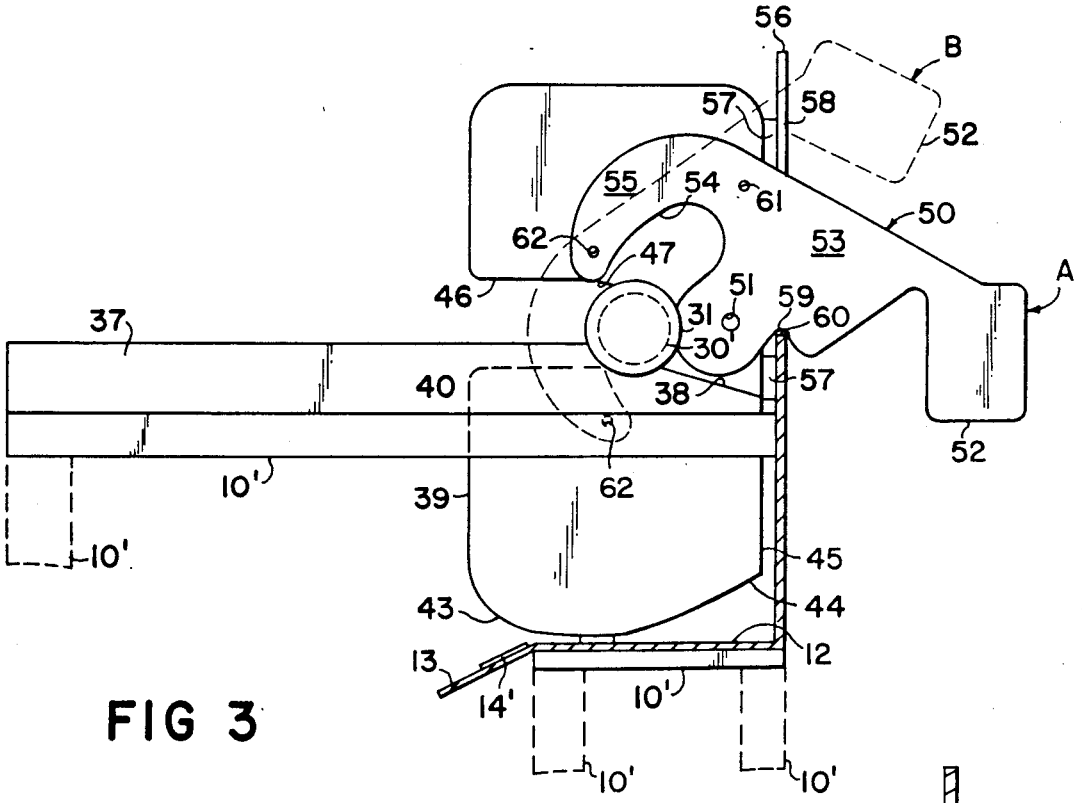
FIG. 3 is a partial right side elevational view of a weight on the left weight tray assembly of FIG. 1 illustrating the operation of a retaining clip used for securing a weight to and releasing it from the barbell of FIG. 2.

With respect to FIG. 3, one embodiment of the improved selection mechanism includes the retaining clip 50. A clip 50 is pivotally secured to one planar side of each weight 39 via a bolt 51. The clip 50 is formed from a single piece of sheet metal and includes handle 52, a main body 53 and a generally crescent-shaped bar engaging portion 55 which functions as a hook member with interior slot surface 54. The rear wall 56 may include rubber pads 57 affixed to the wall 56 between the plurality of slots 58. Slots 58, when used with this particular retaining clip 50, extend through the top edge of the wall 56. A clip 50 is moved between solid line position "A" where the associated weight 39 is secured to bar 30 to broken line position "B" where the weight 39 is selected and positioned against a respective weight engaging area 32 on the sleeve 30'. The weight engaging areas 32 are sized by way of shoulders 31 to accommodate the width of an associated weight 39 and the width of clip 50. The hook member 55 is shaped and sized to fit closely adjacent the sleeve 30' inwardly of the adjacent shoulder 32.

In the improved weight 39, the slot 40 is recessed further rearwardly than in the prior system to cause the weight 39 to rotate forwardly at least 15° from the upstanding stored position to insure that all of the weight 39 is supported on the bar 30/sleeve 30' with minimum weight being on the retaining clip 50. The lower part of body 53 has a notch 59 which rests against the lower edge 60 of slot 58 to prevent forward motion of an unselected weight due to friction between surface 47 and sleeve 30' when bar 30 is moved forwardly with selected weights thereon. The clip 50 is secured into position "A" by placing interior depression 62 over a spring-loaded ball detent 48 formed in weight 39. When the clip 50 is lifted upwardly, depression 61 is rotated over the detent 48 to secure the clip 50 into position "B". It is to be understood that clip 50 could have a ball detent such as 48 formed therein and the pair of depressions 61, 62 formed in the body of weight 39. Alternatively, depression 62 can be omitted with reliance placed solely on notch 59 and slot 58.

Figure 5:
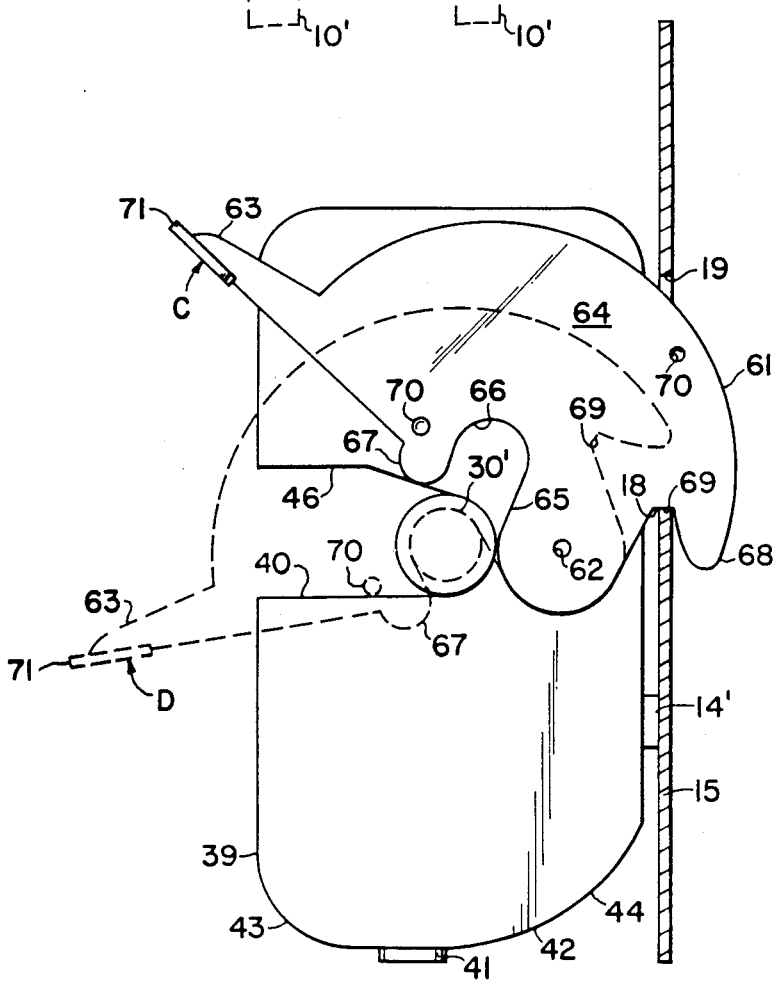
FIG. 5 is a partial side elevational view of an alternate locking apparatus in accordance with the present invention.

FIG. 5 illustrates an alternate retaining clip 61 secured to a weight 39 via bolt 62. Clip 61 is designed to be operable from the front of the weight system and includes handle portion 63, main body 64 and sleeve-engaging portion 65 having inner surface 66. Main body 64 is cut to provide a protruding lip 67 and a rearward finger 68 having a notch 69 adjacent thereto. The clip 61 also includes a ball detent depressions 70 to secure the clip upwardly at an angle of approximately 50° shown in solid line position "C" for storage and release of the weight 39. When clip 61 is lowered to the secured position shown in broken line at "D", inner surface 66 will fit closely adjacent the surface of sleeve 30' positioning lip 67 below the opening of slot 40 to insure an adequate securing action and prevent forward movement of bar 30 from flipping the clip 61 to an open/-release or immediate position which is unacceptable from a safety viewpoint. When clip 61 is in the open/-release position "C", notch 69 is moved downwardly toward the bottom 18 of slot 16 and finger portion 68 is moved to a position rearward of wall 15. Frictional engagement of slot 40 with sleeve 30' cannot move the unselected weight 39 forward because clip 61 would make contact with wall 15 below the slot 16. Finger 68 can fit through hole 17 if the weight 39 is slightly misaligned. Preferably, the handle portion 63 includes a tab 71 which is bent 90° from the plane of the clip body 64 and preferably includes markings to indicate the value of the associated weight 39. Both clips 50 and 61 use a pivot point (at bolts 51, 62, respectively) with respect to the bar 30 and a "hook-like" engaging portion to greatly reduce the possibility of accidental opening of either clip 50 or 61 by forward movement of bar 30.

The operation of the barbell system employing the improvements in accord with the present invention is substantially similar to the operation of the system as before. The number of weights 39 desired and their relative location are selected by moving clip 50 to position "B" or clip 61 to position "D" to select the associated weight 39. The selected weight 39 is secured to engaging area 32 of sleeve 30' between a pair of shoulders 31. The barbell 30 is moved forwardly to lift the selected weights 39. When a particular exercise is completed, the barbell 30 is returned to the stored position by placing guide wheels 34 into guide channels 22 and moving the assembly rearwardly. The tapered rear portion 44 of weights 39 minimize the "binding" that can occur by an otherwise straight rearward extension of rear side 45 making contact with the forward area of tray 11 making it difficult to push the loaded bar 30 rearwardly. Even if one or more weights 39 are swinging, they will not make direct contact with tray 11 because the rearward lower edge 44 is tapered and each weight 39 is balanced for a forward tilt of about 15°. Accordingly, the first contact a weight 39 has with tray 11 and tray surface 12 is via pad 41 when the barbell assembly is lowered rearward by movement down the ramps 23 and 38 on guide wheels 34 and weight support wheel 36, respectively. Weight spacing members 20 assist in maintaining the position and alignment of those weights 39 that were not selected so that the selected weights 39 can be easily moved onto tray 11 and stored against wall 15 or 56 preferably with rubber noise reduction strips 14' or 57 therebetween.

The forward portion of the guide channel assemblies 21 has a funnel- like structure outboard consisting of sections 28 and 29 to help a user return the barbell 30 to the proper position. Also, as illustrated in FIG. 2, an additional wall 23' may be located inwardly of the respective guide channel 22 to inhibit lateral movement of the guide wheels 34 out of channel 22. Furthermore, the support channels 37 are located in the area near the respective alignment bars (not shown) used in the prior art and thus cooperate with pre-existing alignment apparatus to insure that non-selected weights 39 have not been moved prior to the point of movement of the bar 30 where the loaded bar 30 may be lifted upward and off the guide channels 22.

In summary, the improvements in accord with the present invention relate generally to the support and guidance/alignment apparatus used in the freeweight barbell system of the prior art. The improved alignment means includes the use of weight spacing member 20, 20' to provide improved alignment, spacing and lateral support for the weights 39 primarily when they are stored on weight receiving tray 11.

Ramp members 23 and 38 assist in preventing weights 39 from hanging up on the tray surface 12 when the bar 30 is being returned to the stored position. The weights 39 will be fully stored against the rearwall 15 or 56. The ramps 23 and 38 also assist in reducing the effort required to move bar 30 rearwardly to the stored position. Finally, members 24, 37 also provide a more secure feeling for the user.

Weight support channel 37 cooperates with the weight support element wheels 36 to further improve weight support and alignment by inhibiting bending of bar 30 when heavily loaded particularly by weights 39 toward the middle of the bar where, preferably, the heaviest individual weights 39 are positioned. The flexing of bar 30 could result in the selected weights 39 being lowered vertically with resultant binding against tray assembly 10 or prevent the selected weights 39 from being returned to a stored position reasonably close to the remaining weights that were left on the tray 11.

The weights 39 themselves have been improved to increase the forward tilt to 15° and have been tapered rearwardly at the bottom to minimize friction and prevent binding against the tray surface 12 even if they are swinging when returned to the tray 11. The slot 40 has been altered at its upper surfaces 46, 47 in order to accommodate bar 30 movement on the channel ramps 23 and 38 which, as discussed hereinabove, also assists in weight support and alignment.

The barbell sleeves 30' now include the spaced shoulders 31 instead of the prior art slots with the result that the selected weights 39 or all weights 39, when the bar is stored, are spaced and laterally supported with no contact and therefore no friction between them.

The improved retaining clips 50 and 61 are designed for use with the sleeve 30'/shoulders 31 apparatus on barbell 30. The clips 50 and 61 have rearward extensions to engage the rear wall 15 or 56 to prevent forward movement of a weight 39 that has not been affirmatively selected by operation of the clip 50 or 61. The clips 60 and 61 are also planar in shape and accordingly assist in keeping the weights 39 in the vertical plane by eliminating lateral or sideways tilting either when the weights 39 are on the bar 30 or when they are stored on the tray 11. Both clips 50 and 61 are designed to minimize the possibility of accidental opening during operation which could result in unintended release of a weight 39.

Finally, the funnel-like effect of sections 28 and 29 further assist in guidance of the weighted bar 30 for proper positioning of the weights 39 into the stored position on tray 11. And, depending upon the total possible weight loading of bar 30, sleeves 30' may be replaced by a bar 30' machined to form shoulders 31 and weight engaging areas 32.

The improvements in accord with the present invention can be used single or in combination to achieve greater safety and ease of use than before without interferring with the fundamental objectives of the freeweight barbell system regarding safety and the complete selection of weights 39 either with respect to total weight or weight 39 position or both.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a barbell weight lifting apparatus including a frame comprising an elongated lifting bar having opposite end portions, a plurality of planar weights adapted to be selectively attached to said bar, selective means on each said weight for detachably securing said weights to said bar, each said weight having an identically positioned horizontally disposed lateral slot therein extending from a generally upright edge of said weight to generally medially thereof, said bar being positionable through each said slot at respective said weights, selective said weights being directly connected to and supported by said bar, support means for movably positioning and storing said weights upstanding in a horizontal row including a pair of spaced weight receiving trays each having an upper surface and being affixed to said frame adjacent respective end portions of said bar, the improvement comprising alignment means attached to each said tray to align the weights thereon, said alignment means including a plurality of upright spacing members spaced along and affixed to said upper surface of said tray for aligning said weights horizontally when said weights are stored on said tray.

2. In the apparatus as defined in claim 1 wherein said spacing members are elongated triangular elements perpendicular to said bar and having a horizontal base, said base being affixed to said upper surface to provide guides along and adjacent lower portions of said weights during sliding movement of said weights in a horizontal direction.

3. In the apparatus as defined in claim 1 wherein said alignment means includes a pair of elongated spaced guide channels respectively along a side of an adjacent said weight receiving tray to accommodate a pair of spaced round guide wheels mounted on respective said end portions of said lifting bar and being disposable in corresponding said guide channel for positioning said bar in horizontal alignment with all said slots of said weights, each said guide channel having a front end portion and a rear end portion, said alignment means including a downwardly disposed ramp portion on each said rear end portion of said guide channel, said guide wheels being disposed on corresponding said ramp portion when said bar is positioned through each said slot in respective said weights.

4. In the apparatus as defined in claim 3 wherein said alignment means further includes guide wheels sized in diameter such that selected said weights are lifted off said upper surface of said tray when said bar is moved forwardly to move said guide wheels forwardly and upwardly on respective said ramp portions.

5. In the apparatus as defined in claim 3 wherein said guide channels include an outer edge portion and an inner edge portion, a substantially vertical wall adjacent to said outer edge portion and including a frontal wall portion and a rearward wall portion, the alignment means including an outwardly extending section on said frontal wall portion to guide respective said guide wheel inwardly into said guide channel.

6. In the apparatus as defined in claim 1 wherein each said alignment means includes a spaced outer weight support element affixed to said upper surface of each said tray, each said support element positioned outwardly adjacent the outermost said weight positionable on said tray to provide lateral alignment of said outermost weight.

7. In the apparatus as defined in claim 1 wherein said alignment means further includes a pair of spaced sleeves coaxially positioned around said lifting bar, the alignment means including each said sleeve having a plurality of spaced apart circumferential shoulders thereon, each pair of said shoulders defining a weight engaging area of said bar therebetween for positioning each said weight in a respective said area, said weights thereby being positioned spaced apart.

8. In the apparatus as defined in claim 7 wherein said alignment means includes a movable lever pivotally mounted on a side of said weight, said lever having a first position transversing said slot forwardly of said bar for securing said lifting bar in said slot and for securing said weight to said bar in respective said weight engaging area and a second position removed from said slot for allowing free movement of said lifting bar into and out of said slot.

9. In the apparatus as defined in claim 8 wherein said alignment means further includes means to engage said lever, said lever including a protruding portion for engaging said means when said lever is pivoted to said second position to release a selected said weight, said means cooperating with said protruding portion to inhibit movement of such released said weight during movement of said lifting bar into and out of said slot.

10. In the apparatus as defined in claim 1 wherein said alignment means includes a pair of spaced apart bar support elements mounted on said bar, each said element being positioned at a point intermediate the length of said bar, and further including a pair of elongated spaced bar support channels affixed to said frame and being positioned below a corresponding said bar support element, said support elements disposed in corresponding said support channel when said bar is positioned in horizontal alignment with said slots in said weight for restricting downward movement of said intermediate portion of said bar.

11. In the apparatus as defined in claim 10 wherein each said support channel has a front end portion and a rear end portion, said rear end portion including a downwardly disposed ramp portion each bar support element being disposed on corresponding ramp portion when said bar is positioned through each said slot in respective said weight.

12. In the apparatus as defined in claim 10 wherein each said bar support element includes a wheel, means for rotatably mounting said wheels on said bar.

13. In the apparatus as defined in claim 10 wherein said support channels are located above a portion of an adjacent said weight tray.

14. In the apparatus as defined in claim 1 wherein said alignment means includes an improved weight having planar sides and a bottom portion having a forward portion and a rearward portion, said rearward portion being tapered upwardly to reduce sliding friction when said weight is moved rearwardly onto said weight receiving tray.

15. In the apparatus as defined in claim 1 wherein each said weight is pivotal about said bar when said weight is selectively secured to said bar, the portion of each said selected weight forwardly of said bar being heavier than the portion of said weight rearwardly of said bar to cause forward pivotal movement of each said selected weight to place substantially all of the load of each said selected weight onto said bar and minimize force on said selection means.

16. In the apparatus as defined in claim 14 wherein each said selected weight is pivotal forwardly 5°-20° from the stored upstanding position when respective said weight is moved forwardly off said tray.

17. In the apparatus as defined in claim 1 wherein said slot in each said weight has a substantially horizontal bottom surface and a top surface disposed downwardly from said upright edge to a point generally medially in said weight, the vertical distance between said bottom surface and said top surface proportioned to allow for restricted vertical movement of said bar as said bar is movably positioned along said slot.

18. In a barbell weight lifting apparatus including a frame, comprising an elongated lifting bar having opposite end portions, a plurality of planar weights adapted to be selectively attached to said bar, support means to position said weights upstanding in a horizontal row, each said weight having an identically positioned horizontally disposed lateral slot therein extending from a generally upright edge of said weight to generally medially thereof, said bar being positionable through each said slot at respective said weights and being selectively secured to selective said weights, selective means for detachably securing said weights to said bar, the improvement comprising alignment means for guiding and supporting said weights and said bar, said alignment means including a plurality of spaced shoulders on said bar defining a plurality of weight engaging areas therebetween, a retaining clip pivotally attached to one side of each said weight having a forward portion which transverses said slot forward of said bar when said bar is positioned within said slot to select said weight when said clip is pivoted to a first closed position for securing said weight thereby in said corresponding engaging area, said alignment means further including means to engage said clip, said clip including a rearward portion having a finger portion for engaging said means when said clip is pivoted open to a second open position to release a selected said weight, said means cooperating with said finger portion to inhibit movement of such released said weight from the upright stored position.

19. In the apparatus as defined in claim 18 wherein said forward portion of said clip is formed as a hook member having an interior surface, said interior surface being closely adjacent said bar when said clip is in said first position.

20. In the apparatus as defined in claim 18 wherein said support means includes a substantially vertical wall, said wall having a plurality of spaced vertically disposed slots therethrough, said finger portion of said clip disposable within a corresponding said slot when said clip is in said second position.

21. In the apparatus as defined in claim 18 wherein said forward portion of said clip extends to a point below said slot when said clip is in said first position to inhibit the opening of said clip when said bar is moved forwardly.

22. In the apparatus as defined in claim 19 wherein said forward portion of said clip includes a downwardly disposed tab, said tab extending below said slot when said clip is in said first position to inhibit the opening of said clip when said bar is moved forwardly.

* * * * *